US006080534A

United States Patent [19]

Aylward et al.

[11] Patent Number: 6,080,534

[45] Date of Patent: Jun. 27, 2000

[54] IMAGING ELEMENT WITH A SUBSTRATE CONTAINING HINDERED AMINE STABILIZER

[75] Inventors: Peter T. Aylward, Hilton; Valerie J. Harris; Thaddeus S. Gula, both of Rochester, all of N.Y.

[73] Assignee: Eastman Kodak Company, Rochester, N.Y.

[21] Appl. No.: 09/141,480

[22] Filed: Aug. 27, 1998

[51] Int. Cl.[7] ..... G03C 1/79; G03C 1/795; G03C 1/815; G03C 8/52

[52] U.S. Cl. ..... 430/512; 430/201; 430/536; 430/538; 430/551; 347/106; 428/513; 524/99

[58] Field of Search ..... 430/536, 538, 430/201, 551, 512; 347/106; 428/513; 524/99

[56] References Cited

U.S. PATENT DOCUMENTS

| | | | |
|---|---|---|---|
| 4,283,486 | 8/1981 | Aono et al. | 430/538 |
| 4,352,861 | 10/1982 | von Meer et al. | 430/538 |
| 4,377,616 | 3/1983 | Ashcraft et al. | 428/213 |
| 4,562,145 | 12/1985 | Woodward et al. . | |
| 4,582,785 | 4/1986 | Woodward et al. | 430/538 |
| 4,632,869 | 12/1986 | Park et al. | 428/315.5 |
| 4,758,462 | 7/1988 | Park et al. | 428/213 |
| 5,055,371 | 10/1991 | Lee et al. | 430/126 |
| 5,100,862 | 3/1992 | Harrison et al. | 503/227 |
| 5,141,685 | 8/1992 | Maier et al. | 264/45.3 |
| 5,244,861 | 9/1993 | Campbell et al. | 430/201 |
| 5,429,916 | 7/1995 | Ohshima et al. | 430/536 |
| 5,514,460 | 5/1996 | Surman et al. | 428/304.4 |
| 5,705,326 | 1/1998 | Kawai . | |
| 5,866,282 | 2/1999 | Bourdelais et al. | 430/536 |

FOREIGN PATENT DOCUMENTS

| | | |
|---|---|---|
| 0 803 377A1 | 10/1997 | European Pat. Off. . |
| WO 93/04400 | 3/1993 | WIPO . |

*Primary Examiner*—Richard L. Schilling
*Attorney, Agent, or Firm*—Paul A. Leipold

[57] ABSTRACT

The invention relates to an imaging element comprising a substrate having at least two polymer layers on the side bearing an imaging layer wherein at least one of said layers has incorporated therein a stabilizing amount of hindered amine.

20 Claims, No Drawings

IMAGING ELEMENT WITH A SUBSTRATE CONTAINING HINDERED AMINE STABILIZER

FIELD OF THE INVENTION

This invention relates to the formation of a coextruded substrate for imaging materials. It particularly relates to improved substrates for photographic materials.

BACKGROUND OF THE INVENTION

Imaging paper, particularly photographic imaging paper, requires materials in the image substrate that provide long-term survivability and stability during both display and storage. These properties are most desirable and have significant commercial value.

It has been proposed in U.S. Pat. No. 5,244,861 to utilize biaxially oriented polypropylene sheets laminated to cellulose photographic paper for use as a reflective receiver for the thermal dye transfer imaging process. In the formation of biaxially oriented sheets described in U.S. Pat. No. 5,244,861, layers of polypropylene are cast against a water-cooled roller and quenched by either immersion in a water bath or by cooling the melt by circulating chilled liquid internal to the chill roll. The cast polymer sheet is then stretched in the machine direction and then stretched in the cross direction. The sheet is then annealed and is wound in roll form ready to be laminated to a paper base substrate. One material that offers excellent orientation properties is polypropylene. While polypropylene offers excellent physical properties, one disadvantage is its thermal and light stability, particularly when $TiO_2$ is present in one or more of the layers. Polypropylene is usually stabilized using a phenolic based antioxidant, but this material does not offer sufficient stability for light keeping and dark keeping yellow edge. In the area of coextrusion of multiple layers, there is a significant advantage over a mono layer of polymer in that the layer(s) containing $TiO_2$ can be reduced in thickness, and the concentration of $TiO_2$ can be significantly increased to achieve the desired sharpness and calorimetric properties. The coextrusion process allows for an overall reduction in expensive pigment materials while achieving superior results. When less material is used, the degree of objectionable yellow edge and overall stability is also reduced. Furthermore, in a coextruded structure, a clear layer of polymer can be placed directly over the layer containing pigment and antioxidants. Sealing the surface of polymer from the atmosphere can also help to significantly reduce the amount of dark keeping yellowing.

While a variety of materials may be used to create a coextruded structure, one of the preferred materials is polyethylene because of its chemical inertness during photo processing. Coextrusion further allows the use of dissimilar materials to be extruded simultaneously in a single pass on a machine. Layers such as polyethylene with polyester and/or with polypropylene may add desired strength and optical properties, handling features such as durability, and resistance to long-term degradation. Furthermore, the use of dissimilar materials may provide desired barriers to the transmission of gases such as oxygen, water vapor, carbon dioxide, nitrogen, and other compounds that can create interactions with various chemistries in or on the polymer layers or in the image layer. In addition, the low cost of polyethylene material makes it attractive to use, but only if it is properly stabilized to provide resistance to thermal degradation for polymer processing during manufacture, but also to provide a stable base for light stability, as well as dark keeping.

In U.S. application Ser. No. 08/862,708 filed May 23, 1997, now U.S. Pat. No. 5,866,282 it has been proposed to use biaxially oriented polyolefin sheets laminated to photographic grade paper as a photographic support for silver halide imaging systems. In U.S. application Ser. No. 08/862,708 filed May 23, 1997, advantages including increased opacity, improved tear resistance, and reduced substrate curl are obtained by the use of high-strength biaxially oriented polyolefin sheets. The optical advantages of biaxially oriented polyolefin layers are realized when an opacifying pigment is located in at least one layer of polymer, which may be solid or voided. Either the rutile or anatase crystalline form of titanium dioxide ($TiO_2$) is commonly used for opacity, whiteness, image sharpness, and control of pearlescence. While all these are possible, the coextrusion or series extrusion of a plurality of layers directly onto a substrate provides a simple one-pass process in which the polymers are converted from pellet form to usable layers that are cast onto a substrate without orientation. Since most biaxially oriented machines have a relatively fixed width and, therefore, degree of orientation, the casting of layers directly on paper provides added latitude in the materials that can be used since they are not limited to their ability to be oriented.

Coextrusion is a process wherein more than one melt extruder or pump are used to melt polymers and then the individual melt streams are jointed in a feed block prior to the inlet of an extrusion die. The layers are then cast simultaneously onto a web substrate in a roller nip. Usually there is a temperature controlled roller in the nip that applies pressure to aid in the solidification of the melt polymer layers. In series extrusion usually one layer at a time is applied to the web by melting the polymer and casting it onto the substrate. A series of extruders are used to achieve multilayers on the web.

All polymers are inherently prone to chemical degradation that leads to loss of mechanical properties. They undergo thermal degradation during processing such as extrusion of thin films and photooxidative degradation with long-term exposure to light. $TiO_2$ catalyzes and accelerates both thermal and photooxidative degradation. In the art of resin coating a single layer or coextrusion of multiple layers of polymers onto photographic paper, the melt polymers are extruded at high temperatures and are subjected to high shear forces. These conditions may degrade the polymer, resulting in discoloration and charring, formation of polymer slugs or "gels", and formation of lines and streaks in the extruded film from degraded material deposits on die surfaces. Also, thermally degraded polymer is less robust than nondegraded polymer for long-term stability, and may thereby shorten the life of the print.

Hindered phenol antioxidants are commonly used alone or in combination with secondary antioxidants to stabilize polymers during melt processing, but provide little protection from long-term photooxidation. They are also responsible for some forms of oxidative atmospheric gas yellowing (dark keep yellowing) in prints stored in the dark. This undesirable color may develop on the print or around the print edge with archival keeping, and has been attributed to colored oxidation products of phenolic antioxidants that are formed in the dark in the presence of white pigments such as $TiO_2$.

In U.S. Pat. No. 4,582,785 it is suggested that polymeric hindered amines as the sole stabilizer, when added to polyethylene coated photographic paper, can improve their photostability. In this patent a polymeric hindered amine is claimed as the sole stabilizer for both thermal processing and light stability in a single layer of a polymeric material, preferably polyethylene. Photostabilizers such as the polymeric hindered amine improve the archival qualities of the resin layer, but because of their high cost have not been economical in a single thick pigmented layer of polymer, thereby severely limiting their use. Another disadvantage is that with a mono layer of polyethylene, excessive quantities of $TiO_2$ and HALS are required making the material very expense. In addition, these levels can also interfere with the adhesion of the polymer layer to the base substrate or the emulsion to the polymer layer.

There remains a need to provide an imaging support that contains a plurality of polymer layers, some of what may contain pigments and/or voids and that are extrusion processable with minimal degradation of polymer. In addition, the polymer layers must have exceptional long-term resistance to degradation and embrittlement when exposed to light and other environmental stresses, while providing an imaging support that has exceptional dark stability and prevents discoloration during dark keeping.

PROBLEM TO BE SOLVED BY THIS INVENTION

There remains a need to provide an imaging support that contains a plurality of layers that has improved long-term stability or resistance to degradation and embrittlement when exposed to light and other environmental stresses, as well as to providing an imaging support that has exceptional dark stability and improved prevention of yellow edge.

SUMMARY OF THE INVENTION

An object of the invention is to provide improved imaging materials.

A further object is to provide improved photographic support.

A further object is to provide a base for images that will have improved resistance to polymer degradation with long-term exposure to light.

Another object is to provide an imaging material that has improved dark keeping and, in particular, does not discolor with long-term dark keeping.

Another object is to provide a base resin formulation for imaging that has good thermal processing characteristics.

These and other objects of the invention generally are accomplished by an imaging element comprising a substrate having at least two polymer layers on the side bearing an imaging layer wherein at least one of said layers has incorporated therein a stabilizing amount of hindered amine.

ADVANTAGEOUS EFFECT OF THE INVENTION

The invention provides an imaging support that has long-term stability in both light and dark and also resist yellow edge defects.

DETAILED DESCRIPTION OF THE INVENTION

The invention provides an improved base for photosensitive layers and other image receiving layers. It particularly provides an improved base for color photographic materials that require long-term stability to light and dark keeping conditions, although with recent technology advances, imaging support such as thermal dye transfer, ink jet and electrophotographic images are being made and sold as photographic quality. In these applications it is also desirable for the image and the support to have long-term stability to light and dark keeping conditions. One advantage of this invention is that by using a hindered amine with less than 2300 number average molecular weight results in improved adhesion to paper. This provides an advantage in that it allows the extrusion of these materials at lower melt temperatures. Lower melt temperature results in lower energy cost, as well as improved quality with a reduction of die lines and poly gels. Poly gels are typically an area in the polymer that has been degraded and may be cross-linked. They are often referred to has gel slugs. It results in a raised surface which is objectionable to the viewing customer. With the use of hindered amines the rate of photooxidative degradation, as well as dark keeping discoloration of the imaging support, can be significantly reduced. Another advantage is that by reducing the thermal degradation during melt processing of the polymers, the imaging support does not embrittle, and the life of the print is prolonged compared to non or singularly stabilized imaging supports.

The use of hindered amines with a molecular weight less than 2300 for imaging applications has not been reported, especially in the presence of $TiO_2$ or other pigments. Furthermore, the use of hindered amines in more than one layer allows the use of different specific antioxidants systems in individual layers to optimize the polymer layers for performance and cost. With coextruded layers containing $TiO_2$ or other white pigments, tinting agents, and optical brighteners, the amount of these materials can be concentrated into thin layers resulting in less materials to provide the desired results. This further enables lower amounts of hindered amines to be used resulting in further savings.

The present invention consists of multiple layers of polymer which are extruded to the top of a photographic quality substrate support by melt extrusion. The terms as used herein, "top", "upper", "emulsion side", and "face" mean the side or towards the side of an imaging member bearing the imaging layers. The terms "bottom", "lower side", and "back" mean the side or towards the side of the imaging member opposite from the side bearing the imaging layers or developed image. The term "substrate" as used herein refers to a support or base material that is the primary part of an imaging element such as paper, polyester, vinyl, synthetic paper, fabric, or other suitable material for the viewing of images. As used herein, the phrase "imaging element" is a material that may be used as a support to receive the transfer of images by techniques such as ink jet printing or thermal dye transfer, as well as a support for images formed using silver halide. As used herein, the phrase "photographic element" is a material that utilizes photosensitive silver halide and dye forming couplers in the formation of images. In the case of black-and-white photographic members, the silver halide is present without a dye forming coupler. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch, and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The term "crazing" refers to the point at which the polymer in an imaging element has lost sufficient molecular weight from its starting point that it cracks and embrittles. In an imaging print this becomes very objectionable because it interferes with the viewing of the image which creates a poor quality impression with the customer. Polymer degradation refers to the loss in molecular weight and embrittlement of the polymer.

In the present embodiment of this invention, any suitable polymers of at least two layers wherein at least one layer has a stabilizing amount of hindered amine may be coextruded on the top side of the imaging layer substrate. The hindered amine should be added to the polymer layer at about 0.01–5% by weight of said layer in order to provide resistance to polymer degradation upon exposure to UV light. The preferred amount is at about 0.1–3% by weight. This provides excellent polymer stability and resistance to cracking and yellowing, while keeping the expense of the hindered amine to a minimum. The preferred polymer of said imaging element contains polyethylene, and the plurality of layers has a thickness range at about 6–50 $\mu$m. While polyethylene is the preferred polymer because of its cost and chemical inertness, other polymers such as polypropylene and copolymer of ethylene, as well as polyesters, provide some unique attributes in various end uses. These other materials provide added strength, barrier properties against various gases, gloss, and other favorable attributes.

The preferred hindered amine is poly{[6-[(1,1,3,3-tetramethylbutylamino}-1,3,5-triazine-4-piperidinyl)-imino]-1,6-hexanediyl[(2,2,6,6-tetramethyl-4-piperdinyl) imino]} (Chimassorb 944 LD/FL) because it improves the stability of various polymer layers better than other antioxidants, and the hindered amines are less prone to the dark keeping yellow edge defect. Chimassorb 944 LD/FL provides improvements in crazing and resin stability over conventional phenolic and phosphite antioxidants. Chimassorb 119 which is [1,3,5-triazine-2,4,6-triamine,N,N'''-[1,2-ethanedlylbis[[[4,6-bis[butyl(1,2,2,6,6-pentamethyl-4-piperidinyl)amino]-1,3,5-triazine-2-yl)imino)-3,1 propanediyl]]-bis[N',N''-dibutyl-N',N''-bis (1,2,2,6,6-pentamethyl-4-piperidinyl)] has a much lower number average molecular weight (less than 2300) has also been very effective in providing significant improvements in polymer stability over other nonhindered amine antioxidants. The Chimassorb 119 provides an unanticipated advantage for adhesion of the polymer to the paper base. In a coextruded multilayer polymer, the adhesion of the polymer to paper is significantly improved. This helps to provide improved melt temperature processing latitude which is realized as lower melt temperatures which results in lower gels in the polymer layer. When there is more than one polymer layer, an optimum condition is to have a low number average molecular weight (<2300) hindered amine containing layer directly in contact with the substrate and a higher number average molecular weight hindered amine (<2500) in a layer preferably containing pigment and/or voids between the lowermost layer and the imaging layer. The low number average weight polymer may be between 200 and 2300 in number average molecular weight. In this case the adhesion to the base is improved with the lower number average molecular weight hindered amine, and the higher number average molecular weight hindered amine provides the maximum stability in an upper layer that contains $TiO_2$. The lower molecular hindered amine containing layer may also contain a white pigment such as $TiO_2$. If the layer next to the base substrate is not pigmented, there may be an economical advantage, but not performance advantage, in using a phenolic or phosphite type antioxidant. Coextrusion of multiple layer allows for independent selection of antioxidants that provides maximum benefit for both product usage and manufacture.

In the imaging element at least one layer should contain a white pigment for improved image sharpness and viewing pleasure. The imaging element has at least one layer, of the plurality of coextruded layers, that contains pigment selected from the group of $TiO_2$, $CaCO_3$, Clay, $BaSO_4$, ZnS, ZnO, $MgCO_3$, Talc, and Kaolin. Optical brighteners and tinting compounds may also be added to further enhance the whiteness appeal of the imaging element. The preferred white pigment is $TiO_2$ and is usually added at a level at least 4% by weight of the layer. The advantage of coextrusion is that the $TiO_2$ can be concentrated in a thin layer to provide the desire effect. This provides improved cost efficiency because less pigment materials are needed. When $TiO_2$ is present in a polymer layer and it is exposed to light, there is a chemical reaction that takes place that accelerates the rate of the polymer degradation. With phenolic and phosphite antioxidants, the rate of polymer degradation is improved slightly, but when a hindered amine is added to the polymer and particularly when $TiO_2$ is in the polymer, the rate of polymer degradation is significantly reduced. Furthermore if the polymer containing $TiO_2$ is also voided, the addition of a hindered amine is critical to preventing unacceptable loss in polymer number average molecular weight. The hindered amines are more efficient in providing light and dark keeping stability than phosphites and phenolic based antioxidants. In a photographic print this rate difference can more than double the life of the imaging element.

In a photographic print, image sharpness is an important attribute. In the invention imaging element containing a plurality of layers, the image sharpness can be enhanced by having a higher level of $TiO_2$ in the layer closest to the image layer and a lesser amount in the layer closer to the substrate. In this preferred embodiment it is important that both layers contain a stabilizing amount of hindered amine and, in particular, the layer with the higher amount of $TiO_2$ contains an amount of hindered amine at least equal to the layer with the lower amount of $TiO_2$ in order to keep any loss in number average molecular weight to a minimum. In a structure of a plurality of layers containing a nonpigmented layer that is adjacent to a layer containing pigment, a further reduction in molecular weight can be achieved by placing an amount of hindered amine also in the nonpigmented layer.

In said imaging element having at least two layers, one of which contains voids and in the preferred case said voided layer also contains a white pigment, it is very important to include a stabilizing amount of hindered amine. When $TiO_2$ is the white pigment in a voided layer, there is a synergistic improvement in image sharpness and opacity beyond conventional photographic paper in the market. Since the layer has voids or prefracture points in the polymer layer, the degradation and loss in physical strength of said layer are significantly accelerated over a solid layer containing $TiO_2$. The addition of a hindered amine to the voided and pigmented voided layer is essential to achieve acceptable stability of the imaging element.

When various materials are added to polymers, often there is some degree of chemical interaction that occurs depending on exposure conditions. Such conditions as light exposure, the energy spectrum of said light source, the environmental conditions such as temperature, % relative humidity, environmental gases such as ozone, nitrous oxides, oxygen, water vapor, and other gases can create unexpected problems. Under various conditions even the polymer types and the addenda added to said polymers can create different results. It is, therefore, important to have sufficient flexibility to add varying materials, especially antioxidants, either in combination with others or have the ability to separate the materials to minimize interactions. Since coextrusion has the ability to apply more than one layer to a substrate and there is a desire to provide individual layers that have unique functionality. The layers may have different antioxidants or combinations of antioxidants to achieve the polymer casting and best optical and aging performance at lowest cost. The addition of phosphites and phenolic based stabilizer to a plurality of layers also containing a hindered amine provides some synergistic benefits to polymer degradation. This is especially true when one or more of the layers is polypropylene. Some care needs to be taken in the selection of the phenolic type to minimize dark keeping yellowing. Since interactions may occur when materials are mixed in a single layer, having the ability to separate phosphites and phenolic based antioxidants from hindered amines becomes critical to optimizing the design of the imaging element. Furthermore this also allows the amounts and type to be better managed to provide the optimum cost benefit ratio to the design. Hindered amines are more expensive than other antioxidants; therefore, it is very important to manage the amount and also their placement within said coextruded plurality of layers. The preferred materials for use with polypropylene is a combination of the said hindered amine is poly{[6-[(1,1,3,3-tetramethylbutylamino}-1,3,5-triazine-4-piperidinyl)-imino]-1,6-hexanediyl[(2,2,6,6-tetramethyl-4-piperdinyl) imino]} (Chimassorb 944 LD/FL), and the preferred phenolic based material is pentaerythrityl tetrakis [3-(3,5-di-tert-butyl-4-hydroxyphenyl)proprionate](Irganox 1010) and the preferred phosphite materials is 2,4-bis(1,1-dimethylphenyl) phosphite (Irgafos 168). This combination of hindered amine and phenolic and phosphite are unique for polypropylene layers and is particularly effective when $TiO_2$ is present in that polymer. The hindered phenolic and phosphite antioxidants are needed for thermal processing of the polymer, while the hindered amine provides a synergistic benefit by providing additional protection against loss in number average molecular weight and dark keeping yellowing in the presence of various atmospheric gases. Coextrusion provides the ability to reduce layer thicknesses with high concentrations of pigment such that the overall level of pigment is lower than in mono layers. This lower level of pigment coupled with the ability to provide a layer of polymer free of pigment as a thin layer directly over the layer containing pigment and/or voids is an important factor in reducing yellow edge in polypropylene that is further stabilized with other antioxidants. When the layer next to the substrate contains $TiO_2$, the preferred hindered amine is 1,3,5-triazine-2,4,6-triamine,N,N'"-[1,2-ethanedlylbis[[[4,6-bis[butyl(1,2,2,6,6-pentamethyl-4-piperidinyl)amino]-1,3,5-triazine-2-yl)imino)-3,1propanediyl]]-bis[N',N"-dibutyl-N',N"-bis(1,2,2,6,6-pentamethyl-4-piperidinyl), (Chimassorb 119) because the lower molecular weight of this hindered amine provides for improved adhesion of said layer to the base substrate while providing protection against crazing and dark keeping yellowing.

Since ultraviolet (UV) light is a critical part of polymer degradation, filtering or reducing the amount of UV exposure that reaches the $TiO_2$ also has a positive impact on controlling the amount of crazing of the imaging element. This is accomplished by placing a UV absorbing material between the light source and the $TiO_2$ in the polymer or within the polymer containing $TiO_2$.

The hindered amine stabilizer is very effective in reducing the loss in molecular weight of those layers containing $TiO_2$, but it has also been shown that if the hindered amine is in a nonpigmented layer adjacent to the layer containing $TiO_2$, a benefit is also achieved.

In the design of some imaging and, in particular, photographic products, there may be a need to have one or more layers on the backside of the imaging element to provide improved functional performance such as curl, sliding friction, stiffness, or other property. Said backside layers may also contain a white, black, or even colored pigment to further enhance the opacity or provide a desired attribute. In this case it may also be desirable to incorporate an antioxidant. As previously discussed, the antioxidant may be any of the commercially available materials.

In the preferred imaging element the substrate is comprised of paper, and the imaging layer comprises at least one layer containing silver halide and a dye forming coupler. Paper is preferred as the base because it is low in cost and has long been associated with the feel of photographic prints. It also provides a high degree of stiffness that aids in the photofinishing process.

At least one layer of the plurality of layers should contain a white pigment, and the layers are conveniently manufactured by coextrusion. In U.S. Pat. No. 5,466,519 there is mention of the incorporation of $TiO_2$ in at least one layer in from 5–60% by weight and, in the most preferable case from 20–50%. When there are two of more layers on the side directly under the photographic emulsion, each layer may contain $TiO_2$ in the amount of 5–60% by weight. In addition, when the support contains two or more layers, then a differing amount of $TiO_2$ may be placed in the layer closest to the substrate and a higher amount on the outermost layer. In addition to $TiO_2$, other materials may be added such as bluing agents, optical brighteners, tackifiers, adhesives, carbon, and other materials. Furthermore, surface treatments on $TiO_2$ such as aluminum oxide hydrate and silicon oxide hydrate or even polyhydric alcohol, metallic soap, polysiloxane are described. Antioxidant incorporated from 50–1000 ppm is also disclosed. An example of this is a phenolic based antioxidant that is typically used in resin. The material is 2,6-di-t-butyl-p-cresol and tetrakis (methylene-3-(3,5-di-t-butyl-4-hydroxyphenyl-)propionate) methane. Hindered phenol antioxidants are commonly used alone or in combination with secondary antioxidants to stabilize resin during melt processing, but provide little protection from long-term photooxidation. They are also responsible for some forms of oxidative atmospheric gas yellowing in prints stored in the dark. This undesirable color may develop on the print or around the print edge with archival keeping, and has been attributed to colored oxidation products of hindered phenol antioxidants that are formed in the dark with exposure to oxidizing pollutants, such as oxides of nitrogen in the presence of white pigments such as $TiO_2$ This undesirable effect is further aggravated with higher levels of $TiO_2$, making the advantages sited in U.S. Pat. No. 5,466,519 less than desirable in the photographic or imaging area. One of the primary attributes of a photographic quality print is its long-term photo stability and lack of discoloration in either light or dark keeping conditions. These attributes can best be achieved with the incorporation of a hindered amine light stabilizer which significantly extends the life of the print and also significantly reduces atmospheric gas yellowing. Furthermore, having the ability to selectively place the HALS antioxidant in only those layers containing $TiO_2$ and voids, helps to keep the expense to a mininum while providing superior print stability under a variety of keeping conditions.

The total thickness of the plurality of layers can range from 6 μm to 100 μm, preferably from 12 μm to 50 μtm. Below 12 μm, the layers may not be thick enough to minimize any inherent nonplanarity in the support and would be more difficult to manufacture, although individual layers within the plurality of layers may be in the 3–8 μm range. At thicknesses higher than 50 μm, some improvement in either surface smoothness or mechanical properties is seen, but there is little justification for the further increase in cost for extra materials. With coextrusion of a plurality of layers, one or more of the layers may be pigmented. The coextrusion process allows the layers containing pigment to be made at lower thickness and higher pigment concentration levels than with mono layer extrusion. When combining several melt streams together in a feed block or die and there are differences in the polymer rheology due to polymer melt index, type of pigmentation, or degree of pigmentation, it is necessary to add processing aids to prevent interlayer slippage that create melt fracture imperfections between or within the layers.

The coextruded layers that have been used in this invention may contain a plurality of layers in which at least one of the layers contains voids. The voids provide added opacity to the imaging element. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides additional advantages in the optical performance of the final imaging element. The imaging element may have either a photographic silver halide and dye forming coupler emulsion or an image receiving layer typically used for thermal dye sublimation or ink jet.

"Void" is used herein to mean devoid of added solid and liquid matter, although it is likely the "voids" contain gas. Ideally, the void would assume a round or cylindrical shape similar to a foam bubble. The voids generally tend to be closed cells and, thus, there is virtually no path open from one side of the voided core to the other side through which gas or liquid can traverse. The voids may be formed by known foaming or blowing agents or by expansion of gas extruded under pressure from the die.

Voided layers are more susceptible than solid layers to mechanical failure such as cracking or delamination from adjacent layers. Voided structures that contain $TiO_2$, or are in proximity to layers containing $TiO_2$, are particularly susceptible to loss of mechanical properties and mechanical failure with long-term exposure to light. $TiO_2$ particles initiate and accelerate the photooxidative degradation of polymers. By this invention it is shown by the addition of a hindered amine stabilizer to at least one layer of a plurality of layers and, in the preferred embodiment in the layers containing $TiO_2$ and, furthermore, in the most preferred embodiment the hindered amine is in the layer with $TiO_2$ as well as in the adjacent layers, that improvements to both light and dark keeping stability are achieved. For the purpose of this invention photooxidative degradation means a loss in molecular weight of the base polymer in relation to its molecular weight prior to light exposure.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polyolefins are preferred, as they are low in cost and have desirable strength properties.

The nonvoided layers of the plurality of layers can be made of the same or different polymeric materials as bulk of the coextruded layer. The plurality of layers may also contain very thin layers at or near the surface interface. This allows the use of more expensive polymers that provide needed functionality such as adhesion, higher strength, or improved barrier properties.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region. Bluing agents may also be added to tint the base to a desirable color. Other additives which would improve the physical properties of the sheet or the manufacturability of the sheet may also be added. For photographic use, a white base with a slight bluish tint is preferred.

The coextrusion and quenching of these layers may be effected by any process which is known in the art for producing coextruded layers. The coextrusion process involves extruding more than one layer of polymer through a slit die and rapidly quenching the extruded layers on a substrate as it passes through a pressure nip consisting of a chilled casting drum and a hard roller. The core matrix polymer component of the layers of the web substrate and its components are quenched below their glass solidification temperature.

These composite layers may be coated or treated after the coextrusion with any number of coatings which may be used to improve the properties of the layers including printability, to provide a vapor barrier, to make them heat sealable, or to improve the adhesion to the support or to the photosensitive layers. Examples of this would be acrylic coatings for printability, coating polyvinylidene chloride for heat seal properties. Further examples include flame, plasma, or corona discharge treatment to improve printability or adhesion.

The following examples illustrate the practice of this invention. They are not intended to be exhaustive of all possible variations of the invention. Parts and percentages are by weight unless otherwise indicated.

EXAMPLES

The coextruded films are prepared by extrusion casting several different layers on a chill roll and stripping the film off the roll. A polyethylene/polypropylene film of approximately 50 μm thickness containing layers of polypropylene and polyethylene is cast coextruded against a chill roll and stripped off for this study. The cast coextruded films contain a layer of polyethylene, (L1) which in the final form of a coextruded polymer imaging structure is in direct contact with the image layer. For the purpose of this study the films are not coated on a substrate or emulsion coated. The topmost layer is approximately 3 μm thick and is a low density polyethylene (0.910 g/cc) that is coextruded on top of the next layer (L2) which is a layer of polypropylene or polyethylene (0.93 g/cc density) containing 18% by weight of rutile R104 $TiO_2$. The L2 layer is approximately 7 μm thick. The third layer is approximately 30 μm and is a solid layer of polypropylene or polyethylene (0.93 g/cc density) (L3). A hindered phenol and an aryl phosphite are present in the coextruded polypropylene or polyethylene layer at concentrations of 0.15% of each stabilizer. A hindered amine in the amount of 0.33% or 0.15% by weight of the polymer layer is added to various layers (Table 1) of the sheet structure while adjusting the amount of $TiO_2$ in the L3 layer to be either 0 or 4%. In the coextruded film there is also a layer (L4) of polypropylene or polyethylene of approximately 10 μm on the side opposite of the image contacting side. Table 1 lists the approximate amounts.

TABLE 1

Polyolefin Multilayers - Additives[1]

| sample | wt % HALS in L2 | Wt % HALS in L3 | Wt % $TiO_2$ in L3 |
|---|---|---|---|
| 1 PP Control | 0 | 0 | 0 |
| 2 PP | 0.33 | 0 | 0 |
| 3 PP | 0.33 | 0.33 | 0 |
| 4 PP | 0 | 0 | 4 |
| 5 PP | 0.33 | 0 | 4 |
| 6 PP Control | 0 | 0 | 0 |
| 7 PE Control | 0 | 0 | 0 |
| 8 PE Control | 0.15 | 0 | 0 |
| 9 PE Control | 0 | 0 | 0 |
| 10 PE | 0.15 | 0 | 0 |
| 11 PE | 0.15 | 0.15 | 0 |
| 12 PE | 0.15 | 0.15 | 4 |

PP = Polypropylene
PE = Polyethylene
[1]Samples 1–5 contain ~0.15% Irganox 1010 and ~0.15% Irgafos 168 in all layers, and 18% $TiO_2$ in layer 2 (L2).
Sample 6 does not have any $TiO_2$ in any layer but contains approximately 0.15% Irganox 1010 and ~0.15% Irgafos 168 in all layers.
Sample 7 is a mono layer of polyethylene containing approximately 12% Rutile $TiO_2$ and approximately 0.15% of Irganox 1010 (approximately 31 μm in thickness)
Sample 8 is a mono layer of polyethylene containing approximately 12% Rutile $TiO_2$ and approximately 0.15% HALS (there is no phenolic antioxidant) (approximately 31 μm in thickness)
Samples 9–11 are coextruded polyethylene containing ~0.15% Irganox 1010 and ~0.15% Irgafos 168 in all layers, and 18% $TiO_2$ in layer 2 (L2). As indicated in Table 1, HALS and $TiO_2$ are varied as shown.
Sample 12 is coextruded polyethylene containing only HALS in the layer with $TiO_2$. The clear layers contain ~0.15% Irganox 1010.

As referred to in these examples:

HALS (Hindered amine light stabilizer) is poly{[6-[(1,1,3,3-tetramethylbutylamino}-1,3,5-triazine-4-piperidinyl)-imino]-1,6-hexanediyl[(2,2,6,6-tetramethyl-4-piperdinyl) imino]} (Chimassorb 944 LD/FL).

Irganox 1010 is a phenolic based antioxidant and is pentaerythrityl tetrakis [3-(3,5-di-tert-butyl-4-hydroxyphenyl)proprionate].

Irgafos 168 is the phosphite antioxidant and is 2,4-bis(1,1-dimethylphenyl) phosphite.

$TiO_2$ is a rutile manufactured by DuPont (Type: R-104).

PP is polypropylene (0.93 g/cc).

LDPE is low density polyethylene (0.93 g/cc).

AO refers to antioxidant.

PE is polyethylene.

| Coextruded Base Structure |
|---|
| L1 is a layer of LDPE |
| L2 is layer of PP or PE containing 18% $TiO_2$ |
| L3 is a solid layer of PP or PE |
| L4 is a layer of PP or PE |

*Samples contain ~0.15% Irganox 1010 and ~0.15% Irgafos 168 in all layers, and 18% $TiO_2$ in layer 2 unless otherwise indicated.
HALS and $TiO_2$ are varied in L2 and L3 per Table 1.

The molecular weight of polyolefin components were measured before and after exposure to 100 footcandle continuous illumination for 89 days at 80° C. and were rated to determine their suitablity for long-term archival keeping. Samples without a photographic emulsion were exposed to 1000 ppm of oxides of nitrogen, generated from the acidification of sodium nitrate, in a glass desiccator shielded from light. Spectrogard colorimetry was obtained using the total spectrum range (UV in) and with ultraviolet irradiation filtered out (UV out). Measurements were read in CIELAB units (Y, X, Z, sx, sy, sz, L*, a*, b*, and whiteness) with the samples backed by black paper. A summary rating of the dark keeping yellowing is reported as (unacceptable, fair, good). Results are given in Table 2.

TABLE 2

Loss In Molecular Weight and Dark Keep Yellowing

| | L2 | | L3 | | Loss in | |
|---|---|---|---|---|---|---|
| Sample # | $TiO_2$ | HALS | $TiO_2$ | HALS | Mol. Wt. | Yellowing |
| 1 | Y | N | N | N | ⅔ | Fair |
| 2 | Y | Y | N | N | 2 | Good |
| 3 | Y | Y | N | Y | 1 | Good/Fair |
| 4 | Y | Y | Y | N | ¾ | Fair |
| 5 | Y | Y | Y | Y | 2 | Fair |
| 6 Control | N | N | N | N | 1 | Good |
| 7 PE | Mono layer containing $TiO_2$ and Phenolic AO | | | | ⅔ | Unacceptable |
| 8 PE | Mono layer containing $TiO_2$ and HALS only | | | | 1 | Good |
| 9 | Y | N | N | N | ⅔ | Fair |
| 10 | Y | Y | N | N | 1 | Good |
| 11 | Y | Y | Y | Y | 1 | Fair |
| 12* | Y | Y | Y | Y | 1 | Good |

*Phenolic based antioxidant is present only in the clear layers and HALS is in the layers with $TiO_2$.
Y = material is present.
N = material not present.
Rating for Loss in Mol. Wt. (1 = little to no change, 2 = slight change but acceptable, 3 = moderate change and not acceptable, 4 = heavy and unacceptable).
Yellowing rating: (Good = little to no change, fair = slight to moderate change)

The results from Table 2 readily show that the presence of $TiO_2$ in a polymer layer that has been coextruded and then only stablized with a phenolic and phosphite antioxidant (sample 1) has a nearly unacceptable loss of molecular weight upon exposure to light and temperature conditioning over time. When HALS is added to the layer containing $TiO_2$ (sample 2 vs. sample 1), there is less loss in molecular weight making the sample acceptable. Sample 3 has HALS added to an adjacent layer that does not contain any $TiO_2$. The results were unexpected and unobvious. With the addition of HALS to an adjacent layer (L3) not containing $TiO_2$, a further reduction in loss in molecular weight was obtained (sample 3 vs. sample 2). This improvement provides a significant improvement for photographic and imaging print materials by reducing the chance that the polymer will degrade under the image. It is, therefore, concluded that in a coextruded polymer layer, when HALS is present in at least one layer, there is significant improvements, and there are further improvements when it is added to more than one layer. In sample 4, $TiO_2$ is added to the L3 layer without HALS in that layer. The results show a significant and very unacceptable loss in molecular weight. Sample 5 adds the HALS in combination with the $TiO_2$ in L3 and L2. When sample 5 is compared against sample 4, there is a significant improvement noted. Sample 6 is a control in which there is no $TiO_2$ and no HALS in any of the layers. This provides a relative baseline of comparison when $TiO_2$ is added to the polymer. It clearly shows that $TiO_2$ has a significant role in degrading polymers in the presence of light. Sample 7 is a mono layer of polyethylene that contains $TiO_2$ and a phenolic antioxidant. This sample shows a loss in molecular weight which is not desirable, indicating a need for improvement. Sample 8 is the same as sample 7 expect the phenolic AO has been replaced with HALS. The data indicate a significant improvement with loss in molecular weight, as well as the elimination of dark keep yellowing. Samples 9–11 provide a comparison of phenolic and/or HALS antioxidants in coextruded polyethylene polymer layers in combination with $TiO_2$. Sample 9 combines a phenolic AO and $TiO_2$ and no HALS and shows a nearly unacceptable loss in molecular weight, as well as yellowing. When HALS is added (sample 10), there is an improvement in the loss in molecular weight and yellowing, but when an additional quantity is added in conjunction with more $TiO_2$ (sample 11), the loss in molecular weight is improved, but the yellowing becomes fair. In sample 12, the phenolic antioxidant is removed. Good results are obtained for both loss in molecular weight and yellowing.

In general the performance in both polyethylene and polypropylene are similar. Since polypropylene is more unstable than polyethylene, the amounts of HALS are different between samples 1–5 vs. samples 9–12. Polypropylene requires good thermal stabilization which is best achieved with phenolic antioxidants. This material requires that both phenolic and HALS be present in order to provide sufficient thermal melt processing stability and also provide good protection against light degradation and minimization of yellow edge. The importance of this work is the ability to combine phenolic and HALS antioxidants to optimize the polymer properties. Furthermore it allows the use of the same or different polymers within a coextruded structure to be stabilized either separately or jointly, while achieving good light stability and prevention of yellowing. In general, the yellowing data indicate that when $TiO_2$ is present with a phenolic antioxidant, dark keep yellowing increases and as higher levels of $TiO_2$ and phenolic antioxidants are used as in the case of mono layer extrusion, the amount of yellowing is increased (sample #7 vs sample #2). This points out the advantage of coextrusion in that layers containing $TiO_2$ may be made thinner than mono layers and, therefore, less material is present which in turn minimizes the amount of dark keep yellowing. Samples 1–6 evaluate the impact of phenolic and HALS in combination with $TiO_2$ in coextruded polypropylene layers. To effectively use polypropylene with $TiO_2$, the polymer requires good thermal stabilization for melt processing during manufacture and good light and dark keeping stability. This is achieved by combining antioxidant. Comparing sample 6 to 1–5 indicates the impact of adding $TiO_2$ to a polymer for both loss in molecular weight and yellowing. When a phenolic antioxidant is used by itself, there is higher level of molecular weight loss and some yellowing (sample 6 vs. sample 1). When HALS is added in the other samples, there is an improvement in the loss in molecular weight, and yellowing is kept in a desired range. Sample 4 increases the level of $TiO_2$ in another layer without any additional HALS, and there is a noticeable increase in the molecular weight loss, further indicating the importance of this material.

Samples 8–12 evaluate the effectiveness of these materials in polyethylene. In general, similar results are seen. $TiO_2$ has a negative impact on both the molecular weight crazing and yellowing of the polymer layers. Since polyethylene is more stable than polypropylene, particularly to thermal melt processing, the hindered amine antioxidant is effective for reducing the amount of dark keep yellowing and the loss in molecular weight. In a coextruded plurality of layers, when it is desirable to either combine both polyethylene and polypropylene as separate layers or as layers with the same polymer, it is important to have the ability to stabilize each layer with its own optimum antioxidants that balance the effects of melt processing stability, loss in molecular weight light stability and dark keeping, and cost.

This further emphasizes the importance of HALS in coextrusion and the need to use it in limited quantites with other antioxidants, particularly phenolic based ones, as well as the importance of being able to place HALS in with the desired polymer and antioxidants that are chemically most stable with all the materials in that layer. Having the ability to use different polymers with a specific antioxidant allows freedom to design in added features, such as improved tear resistances, barrier properties, gloss, and other functionality.

The reduction in atmospheric gas yellowing is a direct consequence of the unique combination of factors created by a multilayer format. Although, this combination of factors does not completely eliminate discoloration, it reduces it to a level suitable for archival keep of a white imaging element.

The invention has been described in detail with particular reference to certain preferred embodiments thereof, but it will be understood that variations and modifications can be effected within the spirit and scope of the invention.

What is claimed is:

1. An imaging element comprising a substrate having at least two polymer layers on the side bearing an imaging layer wherein at least two of said layers have incorporated therein a stabilizing amount of hindered amine wherein said at least two layers contain $TiO_2$ with a stabilizing amount of hindered amine and the layer closest to the imaging layer contains a greater amount of $TiO_2$ and wherein said at least one layer contains a stabilizing amount of hindered amine with a number average molecular weight of less than 2300 and another layer that contains a stabilizing amount of hindered amine with a number average molecular weight greater than 2500 and said layer containing a stabilizing amount of hindered amine with a number average molecular weight of less than 2300 is in a layer directly in contact with the substrate.

2. The element of claim 1 wherein said at least one of said polymer layers contains a hindered amine in an amount between 0.01 to 3% by weight of the layer.

3. The imaging element of claim 1 wherein said at least two polymer layers comprise polyethylene.

4. The element of claim 1 wherein said hindered amine comprises at least one of the following poly{[6-[(1,1,3,3-tetramethylbutylamino }-1,3,5-triazine-4-piperidinyl)-imino]-1,6-hexanediyl[(2,2,6,6-tetramethyl-4-piperdinyl) imino]} and 1,3,5-triazine-2,4,6-triamine,N,N'"-[1,2-ethanedlylbis[[[4,6-bis[butyl(1,2,2,6,6-pentamethyl-4-piperidinyl)amino]-1,3,5-triazine-2-yl)imino)-3,1propanediyl]]-bis[N',N"-dibutyl-N',N"-bis(1,2,2,6,6-pentamethyl-4-piperidinyl).

5. The element of claim 1 wherein at least one polymer layer comprises voids.

6. The element of claim 5 wherein said polymer layer containing voids also contains white pigment.

7. The element of claim 1 wherein at least one polymer layer also contains tinting compounds and/or optical brighteners.

8. The element of claim 1 wherein said layer with the higher amount of $TiO_2$ also contains a greater amount of hindered amine than the other layer containing $TiO_2$.

9. The element of claim 8 wherein said at least two layers containing a hindered amine further comprise a stabilizing amount of material selected from the group consisting of phosphite and phenolic based stabilizers.

10. The element of claim 1 further comprising at least one layer comprising a stabilizing amount of material selected from the group consisting of a phosphite and a phenolic based stabilizer separate from the layer comprising the hindered amine.

11. The element of claim 1 wherein at least one polymer layer comprises polypropylene, said polypropylene layer comprises pigments and/or voids, said at least two layers comprise a phenolic antioxidant, and at least said polypropylene layer comprises a hindered amine, furthermore said element comprises at least one polymer layer on the side opposite of the image bearing layer.

12. The element of claim 11 wherein the said hindered amine comprises a hindered amine selected from the group consisting of poly{[6-[(1,1,3,3-tetramethylbutylamino }-1,3,5-triazine-4-piperidinyl)-imino]-1,6-hexanediyl[(2,2,6,6-tetramethyl-4-piperdinyl)imino]} and (1,3,5-triazine-2,4,6-triamine,N,N'''-[1,2-ethanedlylbis[[[4,6-bis[butyl(1,2,2,6,6-pentamethyl-4-piperidinyl)amino]-1,3,5-triazine-2-yl)imino)-3,1propanediyl]]-bis[N',N''-dibutyl-N',N''-bis(1,2,2,6,6-pentamethyl-4-piperidinyl), pentaerythrityl tetrakis.

13. The element of claim 1 wherein the hindered amine is in a layer comprising pigment and there is another stabilizer or UV absorber in at least one layer between said pigmented layer and the imaging layer.

14. A photographic element comprising at least one layer containing silver halide and a dye forming coupler, and below said at least one dye forming layer a base comprising a substrate having at least two polymer layers on the side bearing said at least one silver halide layer, wherein at least one of the layers has incorporated therein a stabilizing amount of hindered amine wherein said at least two layers contain $TiO_2$ with a stabilizing amount of hindered amine and the layer closest to the imaging layer contains a greater amount of $TiO_2$ and wherein said at least one layer contains a stabilizing amount of hindered amine with a number average molecular weight of less than 2300 and another layer that contains a stabilizing amount of hindered amine with a number average molecular weight greater than 2500 and said layer containing a stabilizing amount of hindered amine with a number average molecular weight of less than 2300 is in a layer directly in contact with the substrate.

15. The element of claim 14 wherein said substrate cmprises paper.

16. The element of claim 14 comprising at least one layer comprising a plurality contains voids and/or white pigment material selected from the group consisting of $TiO_2$, $CaCO_3$, Clay, $BaSO_4$, ZnS, ZnO, $MgCO_3$, talc, and kaolin.

17. The element of claim 14 wherein said at least two polymer layers comprise at least one layer comprising a stabilizing amount of material selected from the group consisting of a phosphite or a phenolic based stabilizer separate from the layer containing the hindered amine.

18. The element of claim 15 further comprising at least one layer that contains tinting compounds and/or optical brighteners.

19. The element of claim 1 wherein said imaging layer comprises at least one layer of silver halide photosensitive materials.

20. The element of claim 9 wherein said imaging layer comprises at least one layer of silver halide photosensitive materials.

* * * * *